US005322020A

United States Patent [19]

Bernard et al.

[11] Patent Number: 5,322,020

[45] Date of Patent: Jun. 21, 1994

[54] SHAPED CHARGE

[75] Inventors: Marcel Bernard, Chelles-Les-Coudreax; Michel de Gliniasty, Paris; Alain Kerdraon; Alain Bossi, both of Bourges, all of France

[73] Assignee: Giat Industries, Saint-Cloud, France

[21] Appl. No.: 654,095

[22] Filed: Aug. 17, 1984

[30] Foreign Application Priority Data

Aug. 18, 1983 [FR] France ..... 83 13437

[51] Int. Cl.[5] ..... F42B 12/10

[52] U.S. Cl. ..... 102/476; 102/306; 102/701

[58] Field of Search ..... 102/475, 476, 305-310, 102/701

[56] References Cited

U.S. PATENT DOCUMENTS

| | | | |
|---|---|---|---|
| 3,027,838 | 4/1962 | Meddich | 102/701 X |
| 3,211,094 | 10/1965 | Liddiard, Jr. | 102/701 X |
| 3,517,615 | 6/1970 | Jacobs | 102/305 |
| 4,004,515 | 1/1977 | Mallory et al. . | |
| 4,729,318 | 3/1988 | Marsh . | |

FOREIGN PATENT DOCUMENTS

| | | | |
|---|---|---|---|
| 1018279 | 1/1953 | France | 102/308 |
| 2308906 | 11/1976 | France . | |
| 2325903 | 4/1977 | France . | |
| 610106 | 10/1948 | United Kingdom . | |
| 677824 | 8/1952 | United Kingdom . | |
| 714747 | 9/1954 | United Kingdom . | |
| 1152173 | 5/1969 | United Kingdom . | |
| 1596832 | 9/1981 | United Kingdom . | |
| 1604010 | 12/1981 | United Kingdom | 102/476 |

*Primary Examiner*—Harold Tudor

*Attorney, Agent, or Firm*—Kerkam, Stowell, Kondracki & Clarke

[57] ABSTRACT

A high performance shaped charge for piercing high strength steel has a symmetry of revolution about an axis; a priming system constituted by a punctiform initiating source for producing a detonation wave in a block of donor explosive, and a cavity positioned between the donor explosive and a receiver explosive, the cavity being shaped in such a way that the detonation wave from the receiver explosive which enters a charging explosive is planar and perpendicular to the axis of the charge.

19 Claims, 3 Drawing Sheets

SHAPED CHARGE

BACKGROUND OF THE INVENTION

The present invention relates to a new type of shaped charge and particularly to a hollow charge having a symetrically shaped covering or liner, which can be conical or possibly dihedral, and which covering is projected by a charging explosive that is initiated by a priming explosive block.

Modern development efforts in this technical field are seeking a significant increase in the piercing or perforating power of the shaped charges, particularly hollow charges. This research has led to consideration being given to the use of high performance covering i.e., liner, geometries (closed angles, reduced thickness). These are relatively sensitive to technical defects and particularly to distortions of the priming detonation wave.

The hitherto produced shaped charges are equipped with priming systems that produce spherical waves (punctiform or point priming) or toroidal waves (annular priming). Experimental results have revealed that going from punctiform priming to annular priming leads to an approximately 15% increase in the depths by which high-strength steel is pierced. However, a serious disadvantage of this priming procedure is its lack of performance reproducibility. This is, on the one hand, due to the naturally unstable character of convergent detonation wave systems and, on the other hand, to the considerable sensitivity of the covering projection mechanism of the hollow charge to deviations in symmetry of the detonation wave.

Another problem generally encountered with this type of priming results from the need for the detonation wave to acquire a maximum energy level. This makes it necessary for the detonation wave to pass along an adequate "detonation path" between the initiation point and the covering. Generally this constraint seriously penalizes the weight and overall dimensions of the device.

SUMMARY OF THE INVENTION

The present invention overcomes these disadvantages by means of an improved shaped charge making it possible to simultaneously achieve the following advances:

- use of the highest performance covering geometries (particularly closed angles and reduced thicknesses);
- use of extremely high energy explosives, which are sometimes difficult to prime by conventional methods, particularly in connection with TNT binder explosives;
- technical ease of manufacture and fitting of the charges, because the plane wave produced is relatively insensitive to coaxial deviations between the priming block and the hollow charge block;
- reduced weight and overall dimensions, because the wave produced by the charging explosive has an energy profile which can be immediately used for the projection of the hollow charge cone, so that the latter can be located in the immediate vicinity of the priming system;
- increase in the energy transferred to the covering by the effect of the axial confinement produced, i.e. the rearward expansion of the detonation wave is limited.

The shaped charge according to the invention has a priming system comprising:

- an initiating source for producing a detonation wave in the priming explosive block which is constituted by a donor explosive and a receiver explosive;
- a cavity positioned between the donor explosive and the receiver explosive and shaped such that the surface defining the cavity at the donor explosive cooperates with the shape of the surface defining the cavity at the receiver explosive in such a way that the detonation wave in the receiver explosive and in the charging explosive is planar and perpendicular to the axis of symmetry of the covering.

According to another feature, the surface of the cavity at the donor explosive is either planar or concave (spherical, ellipsoidal, paraboloid, hyperboloid, etc.).

The surface defining the cavity at the donor explosive can be covered with a projection covering i.e., liner, which, during priming, is projected onto the surface defining the cavity on the side of the receiver explosive.

According to another feature of the invention, the projection covering can be metallic, bi-metallic, composite, organic or organometallic. The thickness of the covering can be constant or variable (i.e., decreasing from the axis towards its periphery).

According to another feature, the cavity can be constituted by a vacuum, a gas under a low pressure (equal to or below 1 bar), e.g., nitrogen or by a compressible lightweight material such as a foam.

According to other features:

- the surface defining the cavity at the receiver explosive can be covered with a metallic and/or organic coating;
- the projection covering and the coating on the surface defining the cavity at the receiver explosive constitute a tight capsule;
- the apex of the covering of the shaped charge is positioned in the vicinity of the cavity;
- the priming system only or the complete charge can be confined in a rigid envelope.

BRIEF DESCRIPTION OF THE DRAWINGS

The invention is described in greater detail hereinafter relative to non-limitative embodiments and with reference to the attached drawings, wherein.

DETAILED DESCRIPTION OF THE PREFERRED EMBODIMENTS

Figure 1:
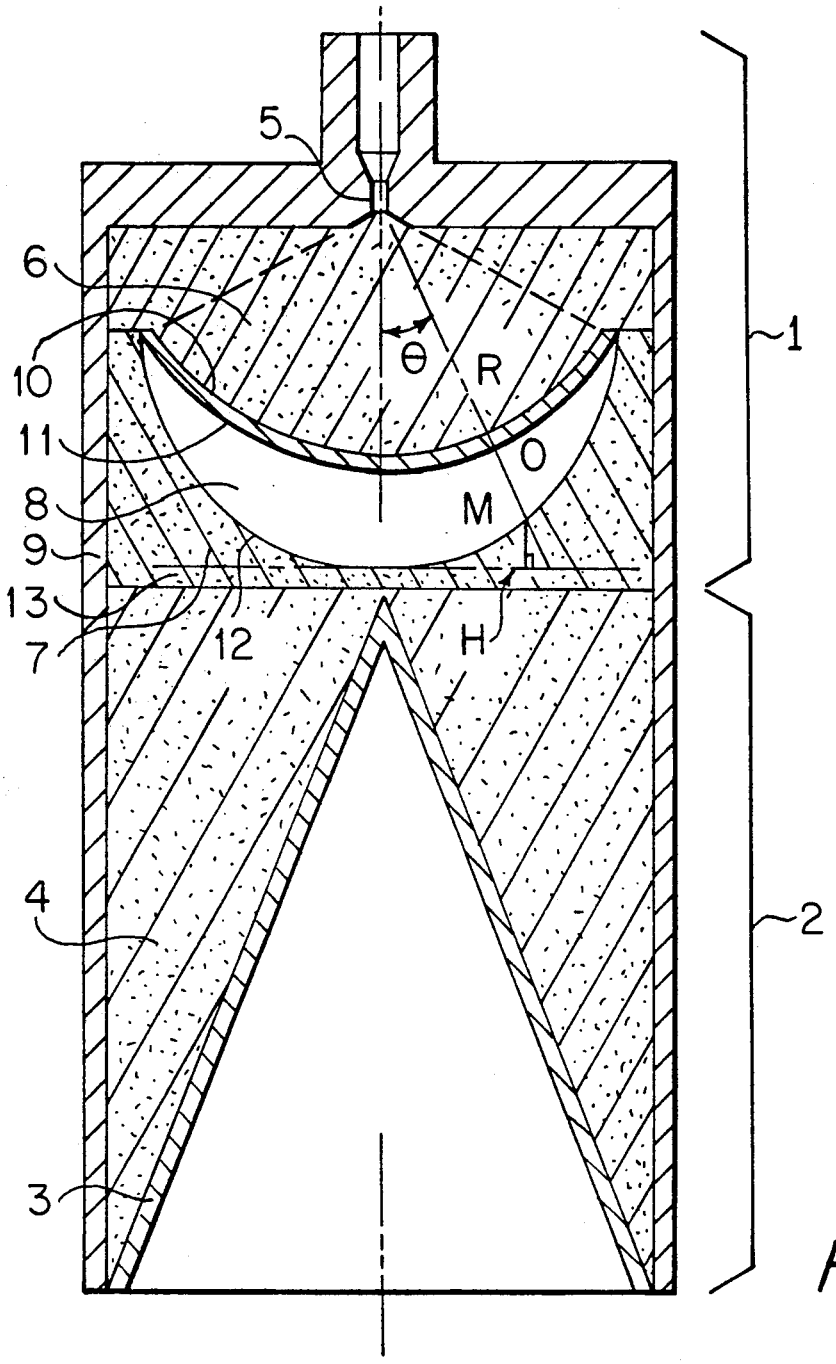
FIG. 1 is a longitudinal sectional view through a shaped charge and its priming device in accordance with the invention.

FIG. 1 shows a first embodiment of a shaped charge comprising priming system 1 associated with a hollow charge 2 which, in conventional manner, includes a conical covering or liner 3 and a so-called "charging explosive" 4.

The priming system comprises a punctiform initiating source 5, a first explosive called the "donor explosive" 6, a second explosive called the "receiver explosive" 7, and a cavity 8 between said donor and receiver explosives, the complete entity being included in an envelope or jacket 9. The envelope may only surround the priming system 1 or may completely envelop the charge. When it is present, said envelope increases the efficiency of the assembly by bringing about a confinement of the detonation products, i.e., by limiting the expansion of the detonation wave.

In the embodiment shown in FIG. 1, the cavity 8, viewed in section, is in the shape of a crescent. Surface 10 of donor explosive 6 is shaped like a sphere having its origin centered on the priming point of the charge. Surface 10 is covered with a metallic, ductile projection covering or liner 11 which, in the particular case described here, is made from copper. The shape of the surface 12 delimiting the cavity on the side of the receiver explosive 7 is defined in such a way that the detonation wave, after the projection covering 11 has passed through the entire cavity 8, is planar in the vicinity of the apex of covering 3.

This surface is determined in the following way. On considering a radius R of the spherical surface 10 forming an angle $\theta$ with the axis of the charge, surface 12 must be such that, to obtain a plane wave at a plane 13 perpendicular to the axis of the charge and tangential to surface 12, it is necessary that:

$$(R + OM)\cos\theta + MH = a$$

$$\frac{R}{D_1} + \frac{OM}{V_0} + \frac{MH}{D_2} = \tau$$

O and M being the intersections of radius R with the respective surfaces 10 and 12, H being the projection of M onto plane 13, $D_1$ and $D_2$ being the respective detonation velocities of the donor explosive and the receiver explosive;

a being the distance between the punctiform initiating source and plane 13, $\tau$ being the time taken by the detonation wave to travel from the punctiform source to the plane 13, and $V_0$ being the projection speed of covering 11.

Surface 12 is then given by the following table:

| Θ (d°) | $\frac{OM}{R}$ |
|---|---|
| 0 | 0.333 |
| 10 | 0.327 |
| 20 | 0.307 |
| 30 | 0.276 |
| 40 | 0.237 |
| 50 | 0.191 |
| 60 | 0.143 |
| 70 | 0.093 |
| 80 | 0.045 |
| 90 | 0 |

Figure 2:
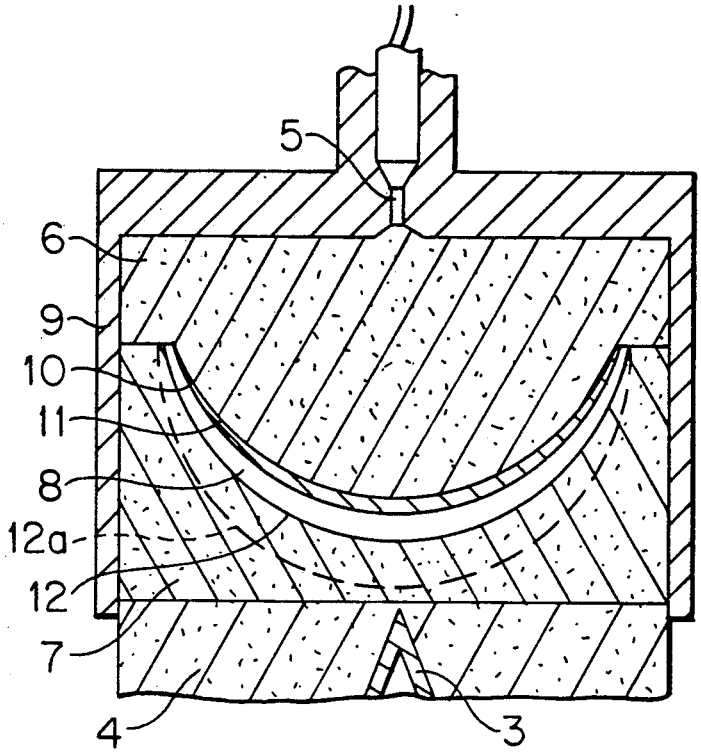
FIGS. 2 to 5 show variants of the priming system

The variant represented in FIG. 2 shows a priming system according to the invention, for which the projection covering 11 has a variable thickness. Thus, the thickness is greater in the area located near the axis of the charge and decreases towards the edges of the cavity. In this particular case, the covering mass or weight per surface unit projected on the opposite face of the cavity during priming decreases in the same way. Thus, the speed of the covering in the axial region is substantially less than that in the peripheral areas. This more particularly leads to a reduction in the distance OM, i.e., the width of the cavity 8 in the area adjacent to the axis of the charge, which makes it possible to obtain a priming system with reduced overall dimensions.

The broken line 12*a* in FIG. 2 indicates what would be the location of surface 12 delimiting the cavity 8 on the side of the receiver explosive 7, on choosing a projection covering 11 with a constant thickness 1 as in FIG. 1.

Figure 3:
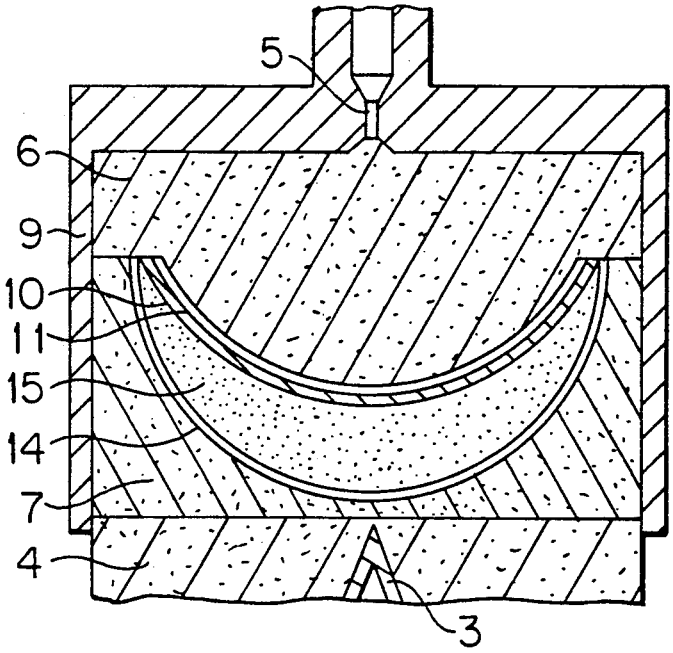

FIG. 3 shows another embodiment, in which the projection covering 11 is made from copper, whilst the receiver explosive 7 is covered with a metallic coating 14, e.g. of steel, which has the function of reinforcing the mechanical strength of the receiver explosive.

Moreover, in this case, cavity 8 is filled with a honeycomb material 15, whereby the latter can be a foam such as expanded polystyrene, which is consequently highly compressed at the time of priming.

Figure 4:
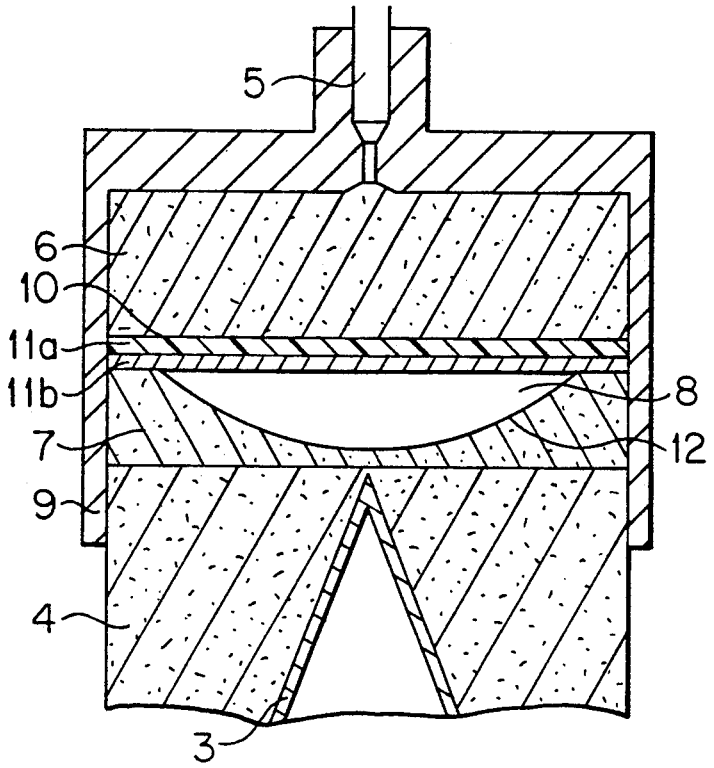

FIG. 4 shows another possible embodiment of cavity 8. The surface 10 of the donor explosive is planar and is covered with a composite projection covering 11, constituted by two plates 11*a* and 11*b*. Plate 11*a* can be made from plexiglass or aluminium and plate 11*b* from copper. The object of this composite structure is to prevent flaking off of plate 11*b*, including during the projection thereof, because a possible flaking off would be prejudicial to the repriming conditions for receiver explosive 7.

Figure 5:
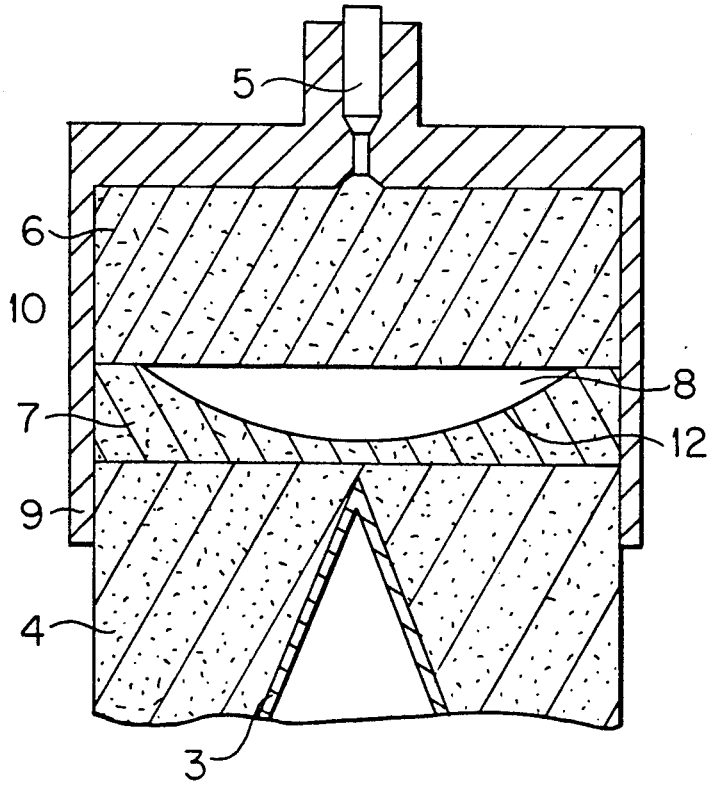

FIG. 5 shows a priming system, in which the surfaces 10 and 12 are not covered by a film, which simplifies the manufacture of the device.

Figure 6:
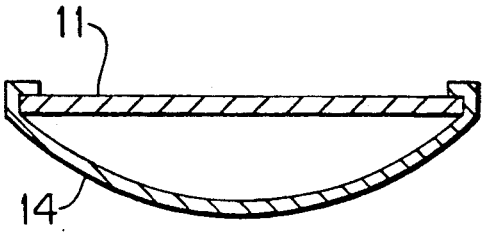
FIG. 6 shows a tight capsule formed by the projection covering and the coating delimiting the cavity on the side of the receiver explosive.

Finally, FIG. 6 shows a capsule which can be tight and which is constituted by the projection covering 11, and the metallic film 14 covering surface 12.

Other variants can be envisaged without passing beyond the scope of the invention. Thus, surfaces 10 can be ellipsoidal, paraboloid, hyperboloid or more generally have a shape such that the surface is expansible, i.e., at the time of the explosion the tangential deformation stresses on the plate or projection covering are tensile stresses. Moreover, the cavities can contain a gas, which can be inert, e.g., nitrogen. A vacuum can also be produced, particularly in the case of the capsule-like cavity of FIG. 6. The projection covering 11, as well as the metallic film 14 can be in intimate contact with the explosives, but can also be arranged in such a way that there is a space between these coverings and the adjacent explosive mass as shown in FIG. 3, whereby said space can be under vacuum or can contain air or a particular gas.

What is claimed is:

1. A shaped charge comprising a charging explosive having a covering with an axis of symmetry, and a priming system incorporating a donor explosive and a receiver explosive for initiating the charging explosive, wherein the priming system comprises:

an initiating source for producing a detonation wave in the donor explosive, which wave is received by the receiver explosive and by the charging explosive; and the donor explosive and the receiver explosive have respective surfaces which define a cavity between the donor explosive and receiver explosive, the surface of the donor explosive defining the cavity being concave shaped toward the initiating source and cooperating with the surface of the receiver explosive so that the detonation wave in the receiver explosive and in the charging explosive is planar and perpendicular to the axis of symmetry of the covering.

2. A shaped charge according to claim 1, wherein the surface of the cavity at the receiver explosive is non-planar.

3. A shaped charge according to claim 1, wherein the surface of the receiver explosive defining the cavity is concave rearwardly toward the initiating source.

4. A shaped charge according to claim 3, wherein the surface of the donor explosive is spherical.

5. A shaped charge according to claim 1, wherein the surface of the donor explosive has a projection covering which, upon explosion of the donor explosive, is projected onto the surface of the receiver explosive.

6. A shaped charge according to claim 5, wherein the projection covering is metallic.

7. A shaped charge according to claim 5, wherein the projection covering is a composite material.

8. A shaped charge according to claim 5, wherein the projection covering comprises a material selected from the group consisting of a multimetallic, an organic or an organometallic material.

9. A shaped charge according to claim 5, wherein the projection covering is symmetrical relative to the axis and has a thickness which decreases from the axis towards a periphery of the projection covering.

10. A shaped charge according to claim 1, wherein the cavity contains a low pressure gas.

11. A shaped charge according to claim 1, wherein the cavity contains a compressible lightweight material.

12. A shaped charge according to claim 1, wherein the surface at the receiver explosive has a coating selected from the group consisting of a metallic or an organic material.

13. A shaped charge according to claim 12, wherein the projection covering and the coating form a tight capsule.

14. A shaped charge according to claim 5, wherein there is a layer of gas between the donor explosive and the projection covering.

15. A shaped charge according to claim 1, wherein the covering of the shaped charge has an apex which is located adjacent to the cavity.

16. A shaped charge according to claim 1, wherein the charge is confined in a rigid envelope.

17. A shaped charge according to claim 1, wherein the surfaces of the donor and receiver explosives both comprise surfaces of rèvolution which are symmetrical with respect to the axis of symmetry.

18. A shaped charge according to claim 1, wherein the surfaces of the donor and receiver explosives are both concave, and together define a cavity which has a crescent shape.

19. A shaped charge according to claim 1, wherein the charging explosive comprises a hollow charge and the covering is conically shaped and symmetrical with respect to the axis of symmetry, with a apex of the covering being located adjacent to the cavity.

* * * * *

UNITED STATES PATENT AND TRADEMARK OFFICE

CERTIFICATE OF CORRECTION

PATENT NO. : 5,322,020
DATED : June 21, 1994
INVENTOR(S) : Bernard et al.

It is certified that error appears in the above-indentified patent and that said Letters Patent is hereby corrected as shown below:

On the cover page of the above-identified patent, at "(73) Assignee", after "Giat Industries, Saint-Cloud, France", please add the following:

--and Commissariat a l'Energie Atomique, Paris, France--

Signed and Sealed this

Twenty-fifth Day of July, 1995

*Attest:*

Bruce Lehman

BRUCE LEHMAN

*Attesting Officer*

*Commissioner of Patents and Trademarks*